US008678259B2

(12) United States Patent
Hurst

(10) Patent No.: US 8,678,259 B2
(45) Date of Patent: Mar. 25, 2014

(54) FLYING DISC CADDY

(76) Inventor: Nathan W. Hurst, Sevierville, TN (US)

( * ) Notice: Subject to any disclaimer, the term of this patent is extended or adjusted under 35 U.S.C. 154(b) by 0 days.

(21) Appl. No.: 13/455,644

(22) Filed: Apr. 25, 2012

(65) Prior Publication Data

US 2012/0205417 A1 Aug. 16, 2012

Related U.S. Application Data

(63) Continuation of application No. 12/336,680, filed on Dec. 17, 2008, now abandoned.

(51) Int. Cl.
*A45F 5/00* (2006.01)

(52) U.S. Cl.
USPC ..... 224/661; 224/671

(58) Field of Classification Search
USPC ..... 224/191, 661, 267, 660, 219, 222, 663, 224/665, 671, 676, 677
See application file for complete search history.

(56) References Cited

U.S. PATENT DOCUMENTS

| | | | | | |
|---|---|---|---|---|---|
| D164,269 | S | * | 8/1951 | Whittier | D19/88 |
| 2,701,173 | A | * | 2/1955 | Senior et al. | 108/43 |
| 3,874,435 | A | * | 4/1975 | Allen | 383/29 |
| 4,115,946 | A | * | 9/1978 | Vukmirovich | 446/27 |
| 4,289,156 | A | * | 9/1981 | Ulics | 135/66 |
| 4,290,226 | A | * | 9/1981 | Stauffer | 446/46 |
| 4,645,103 | A | * | 2/1987 | Bianchi et al. | 224/243 |
| 4,723,695 | A | * | 2/1988 | Farber | 224/153 |
| 4,848,624 | A | * | 7/1989 | Clem | 224/222 |
| 5,255,612 | A | * | 10/1993 | Anderson | 108/43 |
| D367,356 | S | * | 2/1996 | Brown, Jr. | D3/226 |
| 5,615,817 | A | * | 4/1997 | Shevers, Jr. | 224/267 |
| 6,129,254 | A | * | 10/2000 | Yu | 224/575 |
| 6,390,348 | B1 | * | 5/2002 | Godshaw et al. | 224/674 |
| 6,634,531 | B2 | * | 10/2003 | Conte | 224/407 |
| 2002/0017411 | A1 | * | 2/2002 | Weiss et al. | 180/168 |
| 2002/0113102 | A1 | * | 8/2002 | Klamm | 224/153 |
| 2003/0222109 | A1 | * | 12/2003 | Weiss | 224/222 |
| 2004/0016784 | A1 | * | 1/2004 | Berry | 224/584 |
| 2005/0236454 | A1 | * | 10/2005 | Godshaw et al. | 224/677 |
| 2007/0080184 | A1 | * | 4/2007 | Cowen et al. | 224/160 |
| 2007/0113338 | A1 | * | 5/2007 | Remblad | 5/420 |
| 2008/0041899 | A1 | * | 2/2008 | Park | 224/271 |

* cited by examiner

*Primary Examiner* — Adam Waggenspack
(74) *Attorney, Agent, or Firm* — Knox Patents; Thomas A. Kulaga

(57) ABSTRACT

An apparatus for carrying flying discs in such a way that the apparatus does not interfere with the selection and throwing of the flying discs. In one embodiment, a flying disc caddy includes a holster, a belt, and a strap. The holster includes a pouch and dividers. The dividers are spaced apart inside the pouch to form pockets or slots. The pockets receive individual flying discs. The holster is slideably attached to a belt. The belt is configured to wrap around the waist of a disc golf player. The belt secures the holster such that the opening of the holster is aligned to the waist. The holster is also attached to a strap. The strap is configured to wrap around the thigh of a disc golf player. The strap secures the lower end of the pouch to the thigh such that the pouch does not flail during play.

17 Claims, 3 Drawing Sheets

FLYING DISC CADDY

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to a disc golf accessory. More particularly, this invention pertains to a carrying system for flying discs.

2. Description of the Related Art

Disc golf is a popular game much like traditional golf. Instead of a ball and clubs, players use a flying disc. A flying disc is thrown from a tee area to a target, which is equivalent to the hole in traditional golf. As a player progresses down the fairway, he must make each consecutive shot from the spot where the previous throw has landed. The trees, shrubs, and terrain in and around the fairways provide challenging obstacles for the golfer. The hole is completed when the flying disc lands in the target. Scoring is based on the number of throws made during the progress from the tee area to the target.

Disc golf players use several discs during play just as the traditional golf player uses several clubs to reach the hole. The basic discs used during play are a driver, a mid-range disc, and a putter. The typical flying disc used in the game is generally less than 27 cm (10.6 inches) in diameter, about 1.9 cm (0.75 inches) thick, and weighs about 200 g (7 ounces). Disc golf players usually carry between 6 and 18 discs while playing. During the game, a player often carries a score pad, a towel, a water bottle, and other items related to playing the game. To better enjoy the game of disc golf, a convenient, organized way to carry several flying discs and various accessories is required. Flying discs are currently carried in bags having either shoulder straps or backpack style straps.

For players using traditional shoulder strap bags, each time the player makes a throw, he must set aside the disc bag. After the throw, he picks the bag up again and proceeds down the fairway to make the next throw. Disc selection usually entails setting down the bag to take a look inside. Apart from the inconvenience, this procedure is particularly troublesome when used on a wet course or when conditions are otherwise unsuitable for setting the bag down. Those players who use the backpack style straps to support the disc bag cannot easily reach the discs while the bag is being carried on the back. It is particularly difficult to select a specific disc from among several in the bag without removing the bag.

BRIEF SUMMARY OF THE INVENTION

I have developed a carrying device, or disc caddy, for flying discs that does not interfere with throwing the discs during play while carrying the discs. A disc golf player can readily access a specific disc with a simple movement of the arm and without repositioning the disc caddy in order to throw the disc. In accordance with the invention, the flying discs are supported adjacent the hip, or thigh, of the player and remain supported during play, including when the player selects and throws a disc. In this way, each flying disc is accessible and removable while being supported in such a way that permits continuous play.

According to one embodiment of my invention, the disc caddy includes a holster, a belt, and a strap. The holster includes a pouch having an open mouth. The mouth is configured to receive several flying discs. In one embodiment, the mouth is configured to receive an accordion-style organizer. The organizer provides slots wherein individual flying discs are received. The holster is configured to receive a belt to secure the mouth at waist level of a player. In one embodiment, multiple holsters are securable by a single belt. The strap is attached to the holster such that the holster is secured to the thigh by the strap. Securing the holster to the player's thigh reduces flailing during a throw. The disc caddy is configured such that the player wears the holster either on the front or on the side of the thigh according to the player's comfort and/or to avoid interference with the player's throw. In one embodiment, the holster includes ribbed padding located such that the ribbed padding provides a ventilation path between the body of the wearer and the holster. In various embodiments, the disc caddy includes a water bottle holder, a pencil holder, a score pad holder, a towel holder, and/or other accessory holders for securing objects during play.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

An apparatus for carrying multiple flying discs in such a way that the flying discs are individually selectable during continuous play is disclosed. In accordance with the invention, the flying discs are supported by the body of the player and remain supported during play, including when the player selects and throws a disc. The flying discs are supported by the player's torso, for example, at the waist, in such a way that the flying discs are located below the waist. Because the flying discs are located below the waist, the player is free to make throws without removing the supporting device. Convenient access to the flying discs is provided by locating the discs within the reach of an arm of the player.

Figure 1:
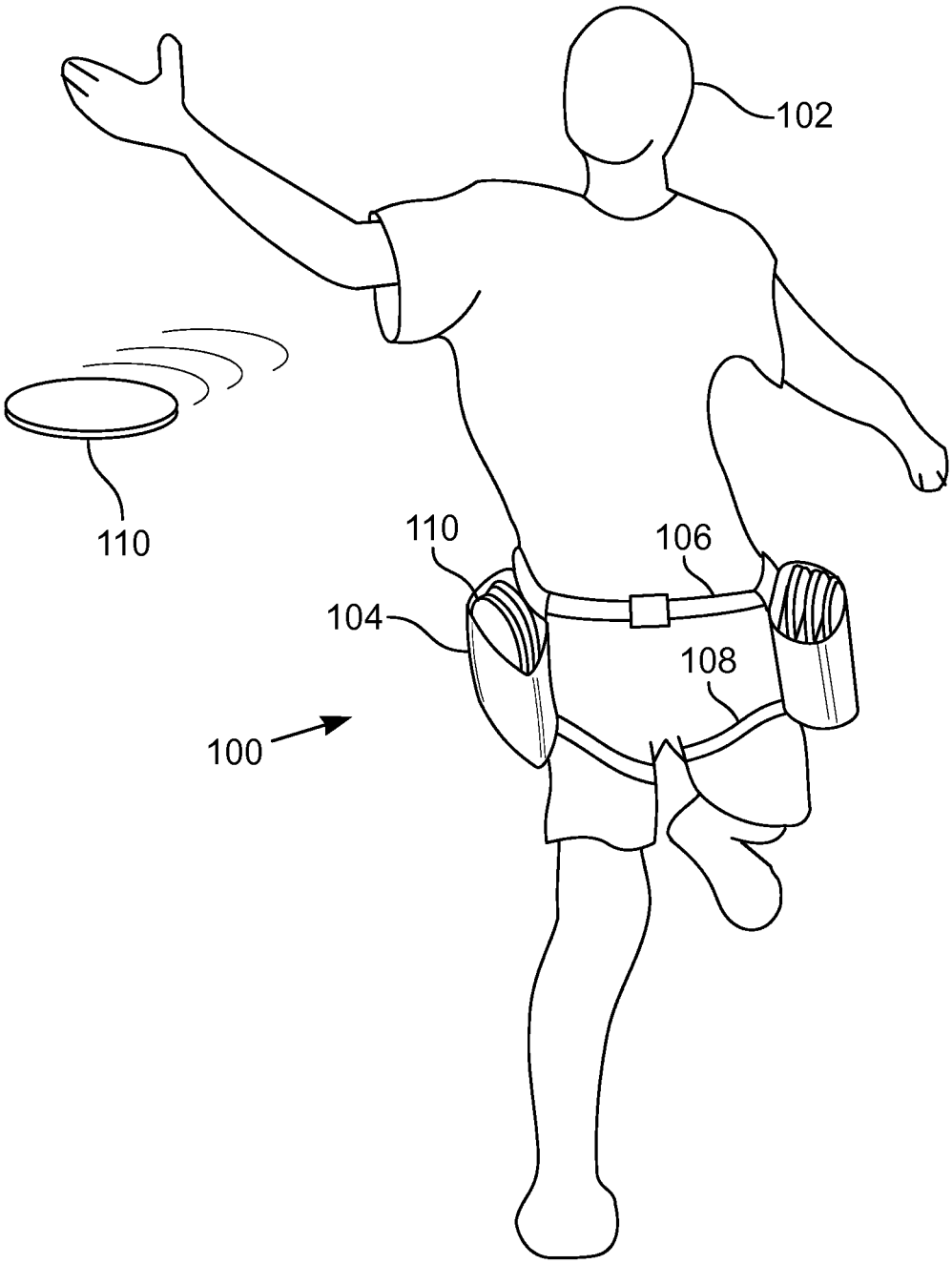
FIG. 1 is a perspective view of a disc golf player throwing a flying disc while carrying one embodiment of a disc caddy.
Figure 2:
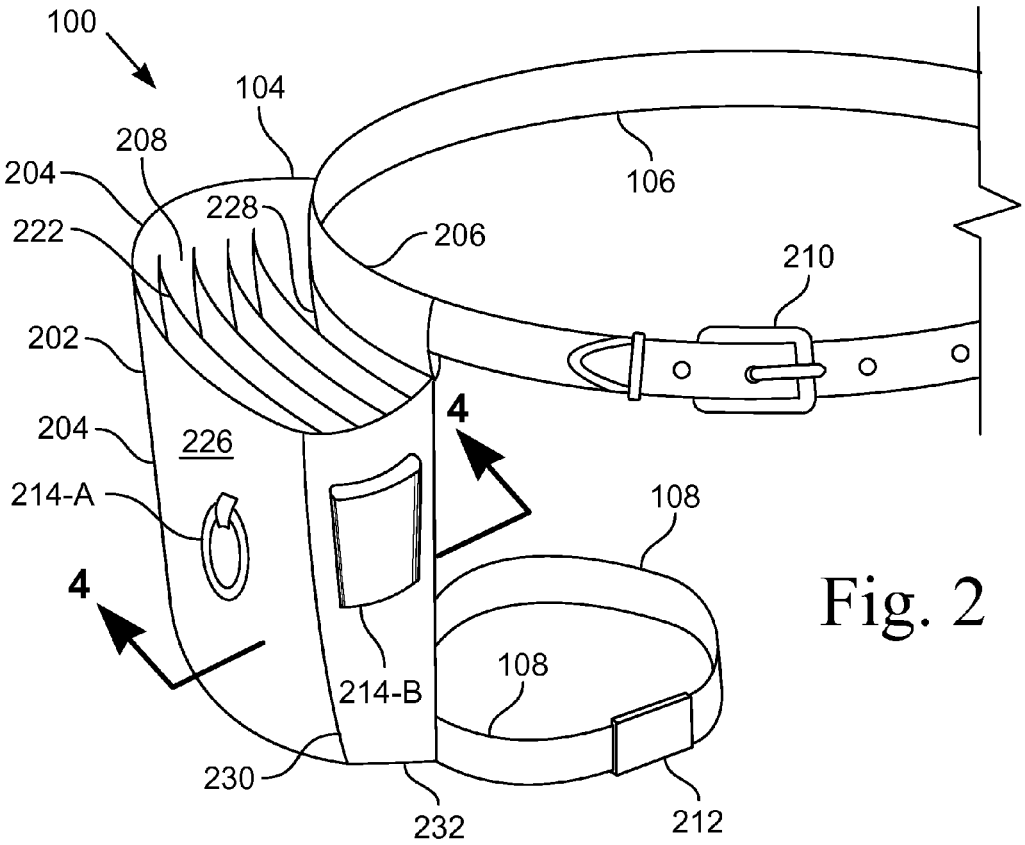
FIG. 2 is a perspective view of the disc caddy shown in FIG. 1.

FIG. 1 illustrates a perspective view of a disc golf player 102 throwing a flying disc 110 while carrying one embodiment of a disc caddy 100. FIG. 2 illustrates a perspective view of the disc caddy 100 shown in FIG. 1. The disc caddy 100 supports the flying discs 110 adjacent the thigh so that the player 102 is able to maneuver as needed to throw the discs 110, whether driving or making a putt. Because the player 102 is able to throw the discs 110 while wearing the disc caddy 100, the player 102 is able to play on a course that is unsuitable for setting down the equipment, such as a course having a wet and/or muddy surface, one that is poorly maintained, or one that is being used by numerous players 102. By using the disc caddy 100, the player 102 maintains physical control of the discs 110 and disc golf accessories while playing the game.

The illustrated embodiment of the disc caddy 100 includes a pair of holsters 104, a belt 106, and straps 108 attached to each holster 104. Each holster 104 is attached to the belt 106 and a strap 108. The disc caddy 100 is configured such that the player 102 wears each holster 104 either on the front or on the side of the thigh according to the comfort of the player 102 and/or to avoid interference with the throw of the player 102. In the illustrated embodiment, the holster 104 position is adjustable along the belt 106. In another embodiment, the disc caddy 100 includes only a single holster 104 attached to the belt 106 and a strap 108.

The holster 104 includes a pouch 202 and inner walls 222. The pouch 202 is configured to contain the flying discs 110. In the illustrated embodiment, the pouch 202 includes a front panel 226, a back panel 228, two side panels 230, and a base 232. The front panel 226 and the back panel 228 are dimensioned to be substantially the size of the largest flying disc 110 to be contained in the pouch 202, that is, the front and back panels 226, 228 have a width that is equal to or greater than the diameter of a disc 110. The front and back panels 226, 228 have a height, in one embodiment, that is equal to or greater than the diameter of a disc 110, thereby enclosing the disc 110 entirely within the pouch 202. In another embodiment, the front and back panels 226, 228 have a height that is less than the diameter of a disc 110, thereby having the disc 110 extend above the mouth 204 of the pouch 202. The two side panels 230 establish the capacity of the pouch 202. The width of the side panels 230 determines the number of flying discs that the pouch 202 is able to accommodate. In the illustrated embodiment, the pouch 202 is sized to receive five flying discs 110. In other embodiments, the pouch 202 is sized to receive a number of discs 110 greater than or less than five. In another embodiment, the pouch 202 is formed by a continuous length of material. In various embodiments, the material of the pouch 202 is sewn together or glued or welded or attached by other methods. In another embodiment, the pouch 202 is formed by a molding process.

The pouch 202 includes a mouth 204, or opening, that permits access to the contents of the pouch 202. The mouth 204 is sized to receive at least one flying disc 110. The mouth 204 is located at one end of the pouch 202. In one embodiment, the pouch 202 includes a wire that encircles the opening or mouth 204. The wire causes the mouth 204 to assume a shape that is substantially fixed such that the mouth 204 remains open during play regardless of the flexibility of the panels 226, 228, 228 of the pouch 202. In one such embodiment, the mouth 204 is substantially rigid and does not deform when normally encountered forces are applied to the mouth 204. In another embodiment, the mouth 204 is resilient such that the mouth 204 is deformable, but returns to an open configuration. In another embodiment, the shape of the mouth 204 is adjustable such that the configuration or shape of the opening formed by the mouth 204 is manually formable. In yet another embodiment, the pouch 202 is molded to a shape such that the mouth 204 holds a rigid form. In one such embodiment, the pouch 202 is injection molded using a plastic resin. In one embodiment, the holster 104 includes a cover or flap that removably covers the mouth 204 of the pouch 102.

The end of the pouch 202 opposite the mouth 204 is a base 232. The pouch 202, in the illustrated embodiment, is closed by the base 232, which is the bottom of the pouch 202. The base 232 supports the flying discs 110 on the edges of the flying discs 110.

The inner walls 222 are positioned between the mouth 204 and the base 232. The inner walls 222 are spaced apart between the front panel 226 and the back panel 228 to form slots 208. The slots 208 receive and secure flying discs 110, which are separated by the inner walls 222. In the illustrated embodiment, there are four inner walls 222 inside the pouch 202 that form five slots 208 for receiving five flying discs 110. In the illustrated embodiment, the inner walls 222 extend from one of the two side panels 230 to the other of the two side panels 230 and the panels 226, 228, 230 extend above the top of the inner walls 222. In one embodiment, the inner walls 222 are attached to the side panels 230. In another embodiment, the inner walls 222 are adjustably attached to the inside surface of the pouch 202. The inner walls 222 are adjustable, in one such embodiment, by a hook and loop system. In other embodiments, the inner walls 222 are adjustable by strategically placed snaps or other connectors within the pouch or by a sliding track on which the inner walls 222 are removably attached or otherwise adjustably attached to the inner walls 222 within the pouch 202.

In one embodiment, the holster 104 includes a compartment adjacent one of the side panels 230. The compartment is formed by a barrier that connects the front panel 226 and the back panel 228, with the barrier being substantially parallel to the side panel 230. In such an embodiment, the inner walls 222 extend from the barrier forming the compartment to the other sidewall 230.

The belt 106 has a length sufficient to be secured about a body part, such as the waist or thigh, of the player 102. The belt 106 is attached to the holster 104 adjacent the mouth 204 of the holster 104. The belt 106 extends orthogonally from the holster 104 relative to an axis that passes through the mouth 204 and the base 232. Further, the belt 106 is substantially in a plane that is perpendicular to that axis. The belt 106 is attached to the holster 104 such that the mouth 204 is at or near the waist of the player 102. The belt 106 provides a first support structure to hold the holster 104 to the waist of the player 102 during play. In the illustrated embodiment, the belt 106 has two ends. The illustrated embodiment shows that the belt 106 has a clasp 210, or closure, that joins the two ends to form a loop and cinches the belt 106 to the waist of the player 102. In other embodiments, the two ends of the belt 106 are releasably joined by another fastener, such as a hook and loop system. In another embodiment, the belt 106 is a closed loop, such as an elastic belt 106 that is pulled over a body part of the player 102.

In the illustrated embodiment, the holster 104 includes a belt loop 206. The belt loop 206 is positioned along a portion of the length of the perimeter of the mouth 204. The belt loop 206 receives the belt 106. In other such embodiments, the belt loop 206 is attached to the back panel 228 or the belt loop 206 is an integral part of the back panel 228 or the belt loop 206 is otherwise secured to the holster 104 such that the holster 104 is supported by the belt loop 206. In another embodiment, the belt 106 is attached at one or more points to the holster 104 without a belt loop 206. In yet another embodiment, the belt 106 includes two straps with an end of each strap attached to the holster 104.

In one embodiment, the disc caddy 100 includes at least one releasable connector that attaches the caddy 100 to a garment or band that is worn by the player 102. In such an embodiment, the releasable connector provides the securing function of the belt 106 and/or strap 108. In various embodiments, the releasable connector is a hook and loop system or press-fit snaps or a spring-biased clip or other releasable connector system.

The strap 108 has a length sufficient to be secured about the leg or thigh of the player 102. The strap 108 is attached to the holster 104 at the end of the pouch 202 proximate the base 232. The strap 108 is a second support structure that secures the holster 104 to a thigh of the player 102 during play. The strap 108 surrounds the thigh such that the holster 104 does not interfere with the movement of the player 102 by flailing during throws. Furthermore, by securing the holster 104 to the thigh, the discs 110 inside the holster 104 remain in place, despite any twisting and lunging movements of the player 102.

In the illustrated embodiment, the strap 108 has two ends connected by a clip 212, or connector, that permits cinching the two ends of the strap 108 around the thigh. The length of the strap 108 is adjustable such that the holster 104 is retained adjacent the leg of the player 102. In other embodiments, the strap 108 is tied around the thigh of the player 102 or the strap 108 is connected by a hook and loop system or the strap 108 is elastic such that it stretches to slide over the thigh and retracts to secure the holster 104 to the thigh or the strap 108 is otherwise secured around the thigh of the player 102.

In the illustrated embodiment, the holster 104 further includes accessory holders 214, for example a towel holder 214-A and a pocket 214-B. The accessory holders 214 are attached to the outer surface of the holster 104.

Figure 3:
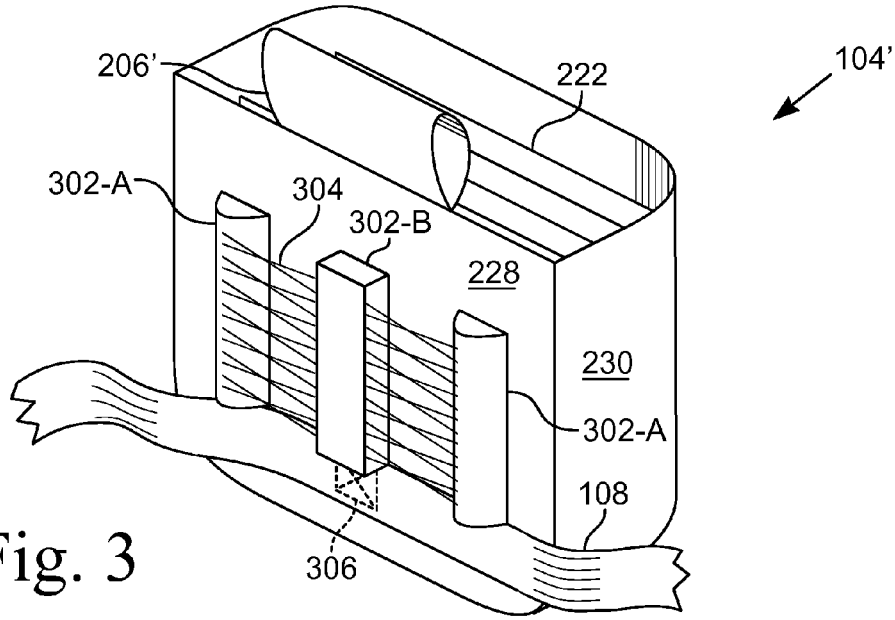
FIG. 3 is a perspective view of one embodiment of a disc holster.

FIG. 3 illustrates a perspective view of one embodiment of a holster 104'. The holster 104' includes a back panel 228 that has ribs 302, or protrusions, and mesh walls 304. The ribs 302 and mesh walls 304 form a suspension system that suspends the holster 104 away from the player 102. The ribs 302 are elongated protrusions that extend, or protrude, from the outside surface of the back panel 228. The mesh walls 304 bridge the gap between adjacent ribs 302. The mesh walls 304 are attached to the outermost portion of the ribs 302 opposite the back panel 228. In one embodiment, the ribs 302 are positioned between the belt 106 and the strap 108. In one such embodiment, the ribs 302 extend substantially the from the belt 106 to the strap 108. In another embodiment, the ribs 302 are located between the mouth 204 and the base 232.

In one embodiment, the ribs 302 are a resilient material that cushions the pouch 202 where the pouch 202 contacts the player 102. The dimensions of the ribs 302 are sized to maintain separation of the back panel 228 from the thigh when worn by the player 102. The ribs 302 are separated a distance less than the width of the thigh of the player 102 and the ribs 302 protrude a distance from the back panel 228 sufficient that the distal ends of the ribs 302 contact the body of the player 102 when the disc caddy 100 is worn by the player 102. In the illustrated embodiment, the ribs 302 are positioned substantially parallel to the length of the leg of the player 102. Because the ribs 302 run parallel to the length of the leg, the pouch 202 hugs the thigh when the holster 104 is attached to the thigh by the strap 108. The ribs 302 are spaced a distance apart that ensures separation of the thigh and back panel 228. In the illustrated embodiment, the ribs 302 include a pair of rounded ribs 302-A and a flat rib 302-B positioned midway between the rounded ribs 302-A. In various embodiments, the ribs 302 include only the pair of rounded ribs 302-A, which contact the leg of the player 102, thereby keeping the back panel 228 from contacting the leg.

The mesh wall 304 is a sheet of flexible material. Opposite ends of the mesh walls 304 are attached to opposing ribs 302 at outboard ends distal to the pouch 202. The mesh walls 304 connect two adjacent ribs 302-A, 302-B. The mesh walls 304 are spaced apart from the back panel 228, thereby forming a gap between the mesh walls 304 and the back panel 228. The ribs 302 are vertically oriented and protrude from the back wall 228 such that an air channel exists between the ribs 302 in the gap between the mesh walls 304 and the back panel 228. The mesh walls 304 also perform the function of stabilizing the ribs 302. The mesh walls 304 attach to the ribs 302 distal to the ribs' attachment to the back wall 228. The mesh walls 304 support the ribs 302 and prevent adjacent ribs 302 from moving apart when a force is applied to the ribs 302, such as when the holster 104 presses against the body of the player 102. In one embodiment, the mesh wall 304 is a web with an open weave. In various embodiments, the mesh wall 304 is a material that absorbs and/or wicks away moisture from the thigh of the player 102.

In one embodiment, the back panel 228 is a semi-rigid material. A back panel 228 that resists bending aids in maintaining the shape of the pouch 202 such that the flying discs 110 readily engage the slots 208 and are not stressed when in the holster 104. The ribs 302 suspend the back panel 228 from the body of the player 102 and provide lateral stability to the holster 104. In another embodiment, the back panel 228 is a flexible material and the distal end of the ribs 302 conform to the shape of the player 102, thereby allowing the back panel 228 to maintain a substantially planar configuration.

The embodiment of the holster 104' illustrated in FIG. 3 shows another embodiment of a belt loop 206'. The belt loop 206' extends only partially across the top edge of the back panel 228. In another embodiment, the belt loop 206 is attached to the back panel 206 at a single attachment point, such as with a stud or rivet. The illustrated embodiment also shows the strap 108 attached at a point 306 on the back panel 228 near the lower center of the panel 228. In this way, the attachment of the belt 106 and the strap 108 to the holster 104' is such that the shape of the back panel 228 remains unchanged instead of being biased to conform to the shape of the body of the player 102. The pair of rounded ribs 302 cradles the leg of the player 102, thereby providing stability to the holster 104'. In another embodiment, the strap 108 engages another belt loop that is attached to the back panel 228.

Figure 4:
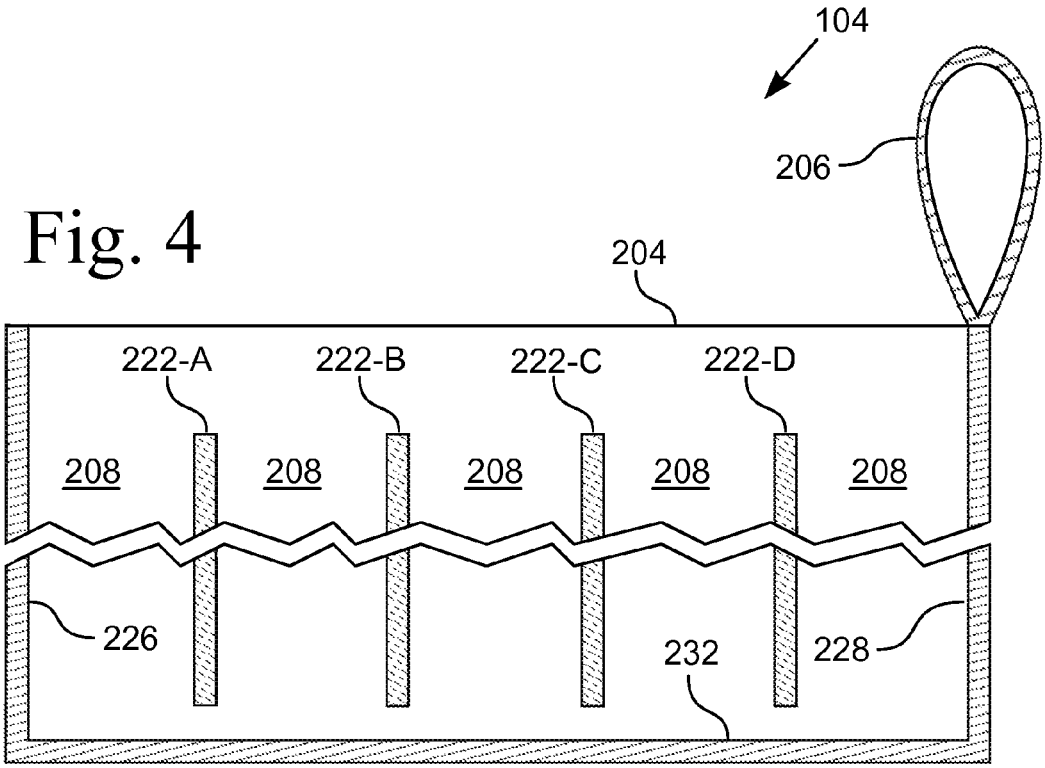
FIG. 4 is a partial cross-sectional view of a holster.

FIG. 4 illustrates a partial cross-sectional view of a holster 104. The illustrated embodiment includes four inner walls 222-A, 222-B, 222-C, 222-D. The inner walls 222 are positioned between the front wall 226 and the back wall 228 such that substantially equal-sized slots 208 are formed between adjacent walls 226, 222, 228. The slots 208 are spaced apart sufficiently to receive a flying disc 110. Also, the slots 208 are dimensioned to secure loosely the flying disk 110 such that the disk 110 will not fall out during normal use of the holster 104. That is, the slots 208 are large enough that the disk 110 fits into it, but not so large that the flying disk 110 rolls side-to-side or flops front-to-back inside the slot 208. In one such embodiment, the slots 208 have a width that is slightly larger than the diameter of the flying disk 110 and front-to-back dimension that is slightly larger than a thickness of the disk 110. In the illustrated embodiment, the inner walls 222 extend partially to the base 232 and partially to the mouth 204. In other embodiments, the inner walls 222 extend to the base 232 and/or extend to or above the mouth 204. In one embodiment, the inner walls 222 are sufficiently rigid to provide a guide when the flying discs 110 are inserted into the slots 208.

Figure 5:
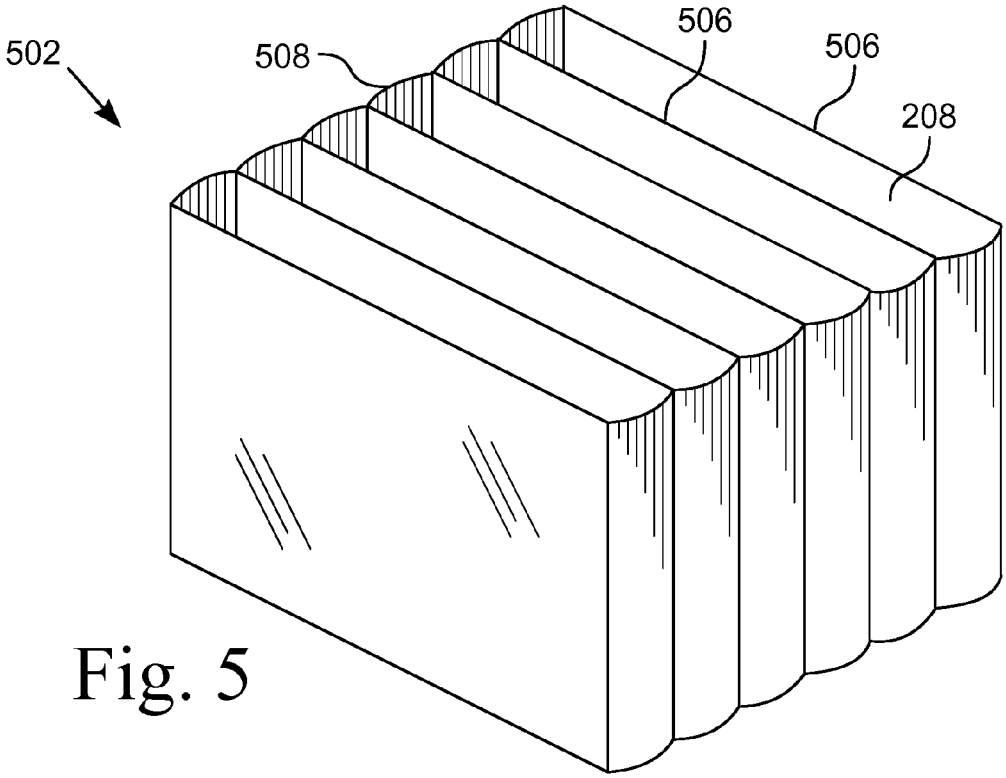
FIG. 5 is a perspective view of one embodiment of a disc organizer.

FIG. 5 illustrates a perspective view of one embodiment of a disc organizer 502. In one embodiment, the disc caddy 100 includes a disc organizer 502 that is removably received by the pouch 202. The disc organizer 502 accommodates those players 102 who prefer a removable slot 208 arrangement.

The disc organizer 502 includes a series of dividers 506 that are joined at opposite ends by end walls 508. The dividers 506 are spaced apart and adjacent dividers 506 define a slot 208. In one embodiment, the end walls 508 are flexible to permit the disc organizer 502 to be expandable. The disc organizer 502 is sized to fit into the pouch 202 of a holster 104 that does not have inner walls 222. The disc organizer 502 provides the player 102 with the flexibility to customize the space inside the pouch 202. In one embodiment, a large sized pouch 202 includes a disc organizer 502 having six slots 208 and further includes space for a player's notebook or snacks or other items.

The flying disc caddy 100 includes various functions. The function of carrying flying discs 110 while playing disc golf is implemented, in one embodiment, by a holster 104 with a belt 106 and a strap 108. The holster 104 includes a pouch 202 and inner walls 222. The flying discs 110 are separated by the inner walls 222. The holster 104 retains the flying discs 110 out of the way below the waist while the player 102 takes shots during the game of disc golf.

The function of supporting the holster 104 at the side of the player 102 is implemented, in one embodiment, by a belt 106 and a strap. The belt 106 is attached to the holster 104. The belt 106 is cinchable around the waist of the player 102 such that the holster 104, holding the flying discs 110, is secured to the waist. The strap 108 is attached to the holster 104 and wrapped around the thigh of the player 102 in such a way that the holster 104 is held securely in place. In one such embodiment, the holster 104' further includes ribs 302 that space the back panel 228 away from the player 102.

The function of organizing multiple flying discs 110 such that the discs 110 are accessible within a pouch 202 is implemented, in one embodiment, by inner walls 222 that define slots 208 that receive the flying discs 110. The inner walls 222 leave a portion of the flying disc 110 exposed so that the fingers of the player 102 can readily grasp a flying disc 110 located in a pocket 208.

From the foregoing description, it will be recognized by those skilled in the art that a flying disc caddy 100 has been provided. In one embodiment, the flying disc caddy 100 is a holster-style carrying device. The flying discs 110 are secured in a holster 104. The holster 104 is configured to be supported at the waist of the player 102 by a first support device that includes a belt 106. The holster 104 is further configured to be supported at the thigh of the player 102 by a second support device that includes a strap 108. In one embodiment, the holster 104 is supported by a third support device that includes a ribbed surface on the back panel 228. The holster 104, in various embodiments, includes holders 214 for disc golf accessories such as pencils, score pads, water bottles, and towels.

A belt 106 and a strap 108 combine to establish a dual support system for the holster 104. The dual support system helps to maintain control of the flying discs 110 without interfering with the movement of the player 102 during a game of disc golf. Because the belt 106 locates the holster 104 at the waist of the player 102, the arms are free to move as needed to throw the disc 110. Because the holster 104 is secured to the thigh, the player 102 is free to make the twisting and lunging motion often required to throw the flying disc 110 without the interference of a flailing holster 104. Further, in one embodiment, the holster 104 is slideably locatable along the length of the belt 106. In that way, the holster 104 is located on the front or side of the thigh according to the comfort and throwing style of the player 102.

While my invention has been illustrated by description of several embodiments and while the illustrative embodiments have been described in considerable detail, it is not my intention to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus for carrying a plurality of flying discs that are suitable for playing disc golf, said apparatus comprising:

a pouch having a first end defining an opening, said pouch including a second end having a base, said second end opposite said first end, said pouch having a back panel between said first and second ends;

a first wall located within said pouch, said first wall substantially parallel to said back panel, said first wall spaced apart from said back panel defining a first slot, said first slot having a width and depth sufficient to accommodate one of said plurality of flying discs with a diameter of 10.6 inches, said first slot dimensioned and configured to receive one of said plurality of flying discs;

a second wall substantially parallel to said first wall, said second wall spaced apart from said first wall defining a second slot, said second slot dimensioned and configured to receive one of said plurality of flying discs;

a first support device attached to said back panel adjacent said first end of said pouch, said first support device including a belt proximate said opening of said pouch such that when said belt engages a waist of a person said opening of said pouch is proximate said waist and above a hip of said person, ;

a second support device attached to said back panel proximate said second end of said pouch, said second support device including a strap configured to engage a leg of said person, said pouch configured to be secured to said person solely by said first support device and said second support device when said person is wearing said pouch;

a third support device including a pair of ribs attached to and extending from said back panel, each one of said pair of ribs being elongated and having a length extending between said first end and said second end, wherein said pair of ribs is dimensioned to support said back panel away from said leg when said pair of ribs engage said leg; and said third support device including a third rib attached to said back panel and disposed between said pair of ribs, said third rib having a distal end that is flat for engaging said leg, and each one of said pair of ribs having a distal end that is rounded for aiding in engaging said leg as said leg curves away from said third rib.

2. The apparatus of claim 1 wherein said first support device includes a belt loop that receives said belt, said belt loop attached to said pouch, said belt loop having a width such that said pouch is supported without swinging sideways relative to an engaging portion of said belt.

3. The apparatus of claim 1 further including at least one of said plurality of flying discs, wherein said first and second slots are dimensioned such that said at least one of said plurality of flying discs is capable of being secured loosely in each one of said first and second slots such that said one of said plurality of flying discs is restrained from rolling side-to-side and restrained from flopping front-to-back.

4. The apparatus of claim 1 further including a sheet suspended between said pair of ribs, said sheet attached to said pair of ribs adjacent an outboard end of each of said pair of ribs, said sheet being a mesh of flexible material.

5. The apparatus of claim 1 wherein said first wall and said second wall are spacedly joined by an end wall to form an organizer, said organizer being removably securable within said pouch.

6. The apparatus of claim 1 wherein said opening is resilient such that said opening is deformable and returns to a shape sized to receive at least one of the plurality of flying discs.

7. The apparatus of claim 1 wherein said first and second walls are fixedly attached inside said pouch.

8. The apparatus of claim 1 wherein said belt loop extends along a majority of a width of said opening of said pouch.

9. The apparatus of claim 1 wherein said pair of ribs are spaced apart with a distance sufficient to cradle said leg between said pair of ribs and to provide lateral stability to said pouch.

10. The apparatus of claim 1 wherein said pair of ribs are spaced apart with a distance sufficient to cradle said leg between said pair of ribs and to provide lateral stability to said pouch, and said distance being less than a width of said leg.

11. The apparatus of claim 1 wherein said strap is attached to said back panel at a centrally located point near the base.

12. An apparatus for carrying a plurality of flying discs, said apparatus comprising:

a pouch having an opening opposite a base, said pouch including a back panel between said opening and said base;

a plurality of dividers inside said pouch, said plurality of dividers spaced apart to define a slot between adjacent ones of said plurality of dividers, each said slot having a width and a depth greater than a diameter of one of the plurality of flying discs wherein each said slot is dimensioned and configured to receive and secure one of the plurality of flying discs;

a first support structure attached to said back panel adjacent said opening, said first support structure including a belt dimensioned and configured to secure around a waist of a person, said first support structure further including a belt loop positioned proximate said opening, said belt loop configured to maintain a substantially constant relative position between said opening of said pouch and a portion of said belt proximate said opening of said pouch;

a second support structure attached to said back panel adjacent said base, said second support structure including a strap dimensioned and configured to secure around a leg of said person, wherein said pouch is configured to be secured to said person solely by said first support structure and said second support structure when said person is wearing said pouch; and a third support structure including a pair of protrusions extending from said back panel, said pair of protrusions being elongated, said pair of protrusions configured to define an unobstructed air gap between said back panel and the leg when said pair of protrusions contact the leg, wherein a portion of said back panel between said pair of protrusions is spaced apart from a body portion of said person when said strap engages said leg, said third support structure including a third protrusion attached to said back panel and disposed between said pair of protrusions, said third protrusion having a distal end that is flat for engaging said leg, and each one of said pair of protrusions having a distal end that is rounded for aiding in engaging said leg as said leg curves away from said third protrusion.

13. The apparatus of claim 12 further including a pair of ribs each attached to said back panel and extending rearward, and further including a mesh suspended between a distal end of each of said pair of ribs.

14. The apparatus of claim 12 wherein said plurality of dividers includes a first panel and a second panel, said first panel and said second panel joined by an end panel to form an organizer, said end panel adjustably spacing apart said first panel from said second panel to match the various widths of said plurality of said flying discs, said organizer being removably securable within said pouch.

15. An apparatus for carrying a plurality of flying discs, said apparatus comprising:

at least one flying disc suitable for playing disc golf;

a belt dimensioned and configured to encircle a torso of a person;

a holster having an opening opposite a base, said belt engaging a belt loop attached to said holster proximate said opening such that said holster is held in a position relative to a portion of said belt proximate said opening of said pouch, said belt loop having a through-opening substantially sized to fit said belt; said holster having a plurality of dividers defining a plurality of slots, each one of said plurality of slots dimensioned and configured to receive said at least one flying disc through said opening, said plurality of slots each having a width greater than a diameter of said at least one flying disc, and said plurality of slots each having a height substantially equal to said diameter of said at least one flying disc, a space above said opening is unobstructed for removal of said at least one flying disc from said holster;

a strap dimensioned and configured to encircle a leg of said person, said strap attached to said holster adjacent said base; wherein said holster is secured to said person solely by said belt and said strap when said person is wearing said holster;

a pair of protrusions extending from said holster between a belt attachment and a strap attachment, said pair of protrusions being elongated, said pair of protrusions configured to define an unobstructed air gap between said holster and said person when said strap encircles said leg and said pair of protrusions are contacting said leg; and a third protrusion attached to said back panel and disposed between said pair of protrusions, said third protrusion having a distal end that is flat for engaging said leg, and each one of said pair of protrusions having a distal end that is rounded for aiding in engaging said leg as said leg curves away from said third protrusion.

16. The apparatus of claim 15 wherein said belt is configured to be attached to said pouch such that said opening is substantially aligned with a waist of said person when said person is wearing said holster.

17. The apparatus of claim 15 wherein said holster includes a cover that fits over said opening of said pouch.

* * * * *